United States Patent [19]

Ericson et al.

[11] Patent Number: 4,524,795

[45] Date of Patent: Jun. 25, 1985

[54] HYDRAULIC DEVICE FOR THE DRAINAGE OF WASTE WATER

[75] Inventors: Kurt S. B. Ericson, Prins Boudewijnlaan, 48, B-2230 Schilde, Belgium; Gijsbrecht H. J. Van Olst, Leusden, Netherlands

[73] Assignee: Kurt Sture Birger Ericson, Schilde, Belgium

[21] Appl. No.: 440,696

[22] Filed: Nov. 10, 1982

[30] Foreign Application Priority Data

Nov. 12, 1981 [BE] Belgium ..... 891.095

[51] Int. Cl.[3] ..... E03C 1/295

[52] U.S. Cl. ..... 137/216.2; 137/247.11; 210/120; 210/305

[58] Field of Search ..... 137/216.1, 216.2, 247.11, 137/254; 210/163, 164, 165, 166, 247, 305, 306, 436, 456, 472, 120

[56] References Cited

U.S. PATENT DOCUMENTS 1,910,186 5/1933 Sisk ..... 210/472 X 3,141,472 7/1964 Russell ..... 137/216.1

4,212,314 7/1980 Ericson ..... 137/216.2

*Primary Examiner*—Richard V. Fisher

*Assistant Examiner*—W. Gary Jones

*Attorney, Agent, or Firm*—Pollock, Vande Sande & Priddy

[57] ABSTRACT

The present invention relates to a waste water outlet for a sanitary plant, comprising a siphon forming a water seal to which is connected a waste pipe for connection with sewers and in which an automatic air valve device and a siphon are combined in one single apparatus so that their functions are complementary. A cylindrical body having a permanent water seal and into which extends an inlet pipe or equivalent connected to an apparatus such as a sink, a basin or waste outlet, is combined with an automatic air valve with peripheral air entry. Outside the inlet pipe extending into the water seal is an internal partition which separates the water seal and the automatic valve device situated at the upper part of the cylindrical body, thereby protecting the valve device against a raising or splashing of the liquid situated in the water seal.

2 Claims, 1 Drawing Figure

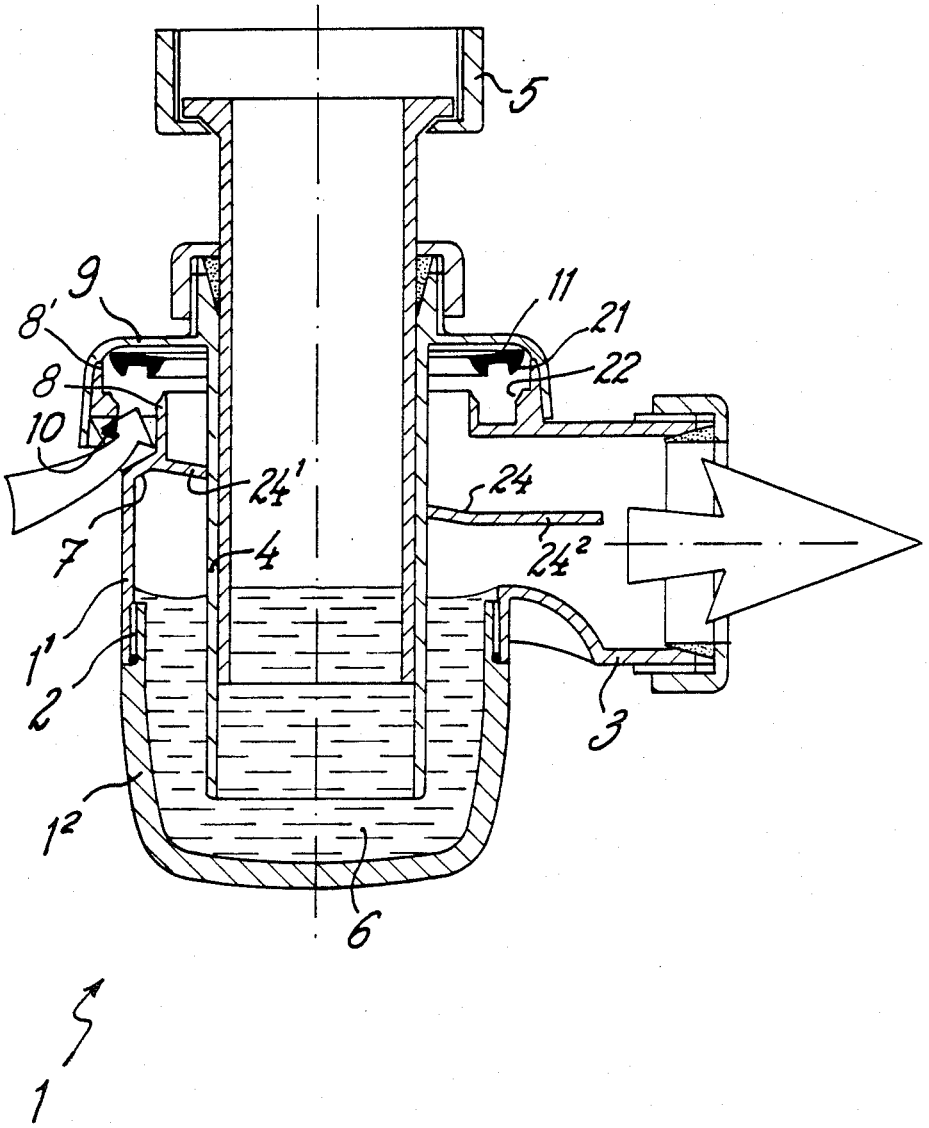
5
9
8'
8
10
11
21
22
24'
24
24²
7
4
1'
2
3
1²
6
1

HYDRAULIC DEVICE FOR THE DRAINAGE OF WASTE WATER

TECHNICAL FIELD AND BACKGROUND ART

The present invention relates to an hydraulic device for passing waste water from a draining unit, such as a sink into a sewer. Such devices are known which comprise a cylindrical body for receiving a water seal therein, an inlet pipe extending from the draining unit into the cylindrical body, an outlet pipe extending from the cylindrical body and adapted to be connected to a sewer, a cover extending over the cylindrical body and defining with the cylindrical body a peripheral air inlet, and an annular valve resting over the peripheral air inlet. The valve blocks the passage of air out of the cylindrical body when air pressure in the outlet pipe is balanced with respect to the pressure exterior of the cylindrical body and when there is an overpressure in the outlet pipe.

Such a device in which an automatic air valve device and a siphon are combined so that their functions are complementary, is described in U.S. Pat. No. 4,212,314 granted to K. S. B. Ericson, one of the present inventors.

DISCLOSURE OF THE INVENTION

Experiments have shown that it is important to protect the automatic air valve device disclosed in the Ericson patent against the raising or splashing of the liquid situated in the water seal.

The object of the present invention is to remedy this inconvenience. Accordingly, an hydraulic device according to the invention comprises, outside the pipe dipping into the water seal, an internal partition which separates the water seal and the automatic valve device situated at the upper part of the cylindrical body.

BRIEF DESCRIPTION OF THE DRAWING

The accompanying drawing shows, as a non-limitating example, how the invention can be put into practice.

The single FIGURE illustrates a cross-sectional view of the device.

BEST MODE FOR CARRYING OUT THE INVENTION

On the drawing, there has been represented a siphon formed of a cylindrical body or container 1 having upper and lower parts $\mathbf{1}^1$ and $\mathbf{1}^2$ joined by a threaded connection 2 and connected to an outlet pipe 3 to be connected with the sewers. In this cylindrical body, an inlet pipe 4 extends downwardly and dips into a water seal 6. As illustrated, the outlet pipe is open to the exposed surface of water seal 6. Pipe 4 may be connected to an apparatus 5 such as a sink, a basin, or the like.

At its upper end the cylindrical body has a construction 7 which may take the shape of a venturi ending with a conical neck 8. Surrounding neck 8 is an upwardly extending lip 8' for cooperation with a cover 9. Between neck 8 and lip 8' is formed an air inlet in the form of a peripheral entry duct 10. An annular valve 11 is situated above conical neck 8 and includes a curved undersurface 21 which cooperates with a valve seat 22 defined by neck 8 and lip 8' when the pressure in outlet pipe 3 equals or exceeds the pressure acting at entry duct 10.

According to the invention, outside inlet pipe 3 is an internal partition wall 24 which separates water seal 6 and automatic valve device 10, 11, 21, 22 situated at the upper part of the cylindrical body, thus 1 protecting the valve device against the raising or splashing of the liquid situated in the seal.

The partition wall 24 is advantageously fixed to the inner wall of the cylindrical body 1. As shown on the drawing, the partition wall preferably comprises a section $\mathbf{24}^1$ inclined downwardly towards the outlet pipe, followed by a section $\mathbf{24}^2$ extended substantially horizontally to the entry of the outlet pipe 3. As illustrated, inlet pipe 4 extends through partition wall 24.

Those skilled in the art will appreciate that the term "cylindrical body" must be understood in a wide interpretation as extending to any polygonal shape.

We claim:

1. In an apparatus for draining waste liquid of the type including a container having an upper part and a lower part; an inlet pipe extending downwardly into said container; a water seal within said lower part, said inlet pipe extending into said water seal; a waste liquid outlet pipe opening from said container at a location above said water seal whereby the upper surface of said water seal is exposed to gas from said waste liquid outlet pipe; an automatic air valve at said upper part, said valve having an air entry duct into said container and a valve element for closing said air entry duct when the pressure acting at said waste liquid outlet pipe equals or exceeds the pressure acting at said air entry duct, the improvement comprising:

an internal partition fixed to the inner wall of said upper part of said container around said inlet pipe and below said air valve, said partition being extended by a substantially horizontal wall section across said upper part into the entry from said container into said waste liquid outlet pipe, whereby said partition separates said water seal from said air valve and protects said air valve against splashing or rising of said water seal.

2. An apparatus according to claim 1, wherein said partition comprises a first wall section inclined downwardly towards the entry of said outlet pipe, followed by a second wall section extended substantially horizontally to the entry of said outlet pipe.

* * * * *